United States Patent [19]

Engstrand

[11] Patent Number: 4,699,737

[45] Date of Patent: Oct. 13, 1987

[54] PORTABLE HUMIDIFIER

[76] Inventor: Bradley W. Engstrand, 2658 N. Dayton, Chicago, Ill. 60614

[21] Appl. No.: 883,660

[22] Filed: Jul. 9, 1986

[51] Int. Cl.[4] ..... B01F 3/04

[52] U.S. Cl. ..... 261/24; 261/91; 261/64.1; 261/120

[58] Field of Search ..... 261/91, 120, 24, 64.1

[56] References Cited

U.S. PATENT DOCUMENTS

| | | | |
|---|---|---|---|
| 1,178,575 | 4/1916 | Collins | 239/34 |
| 2,218,198 | 10/1940 | Harris | 261/91 |
| 2,755,129 | 7/1956 | Lyon | 261/91 |
| 3,287,002 | 11/1966 | Sevald | 261/120 |
| 3,290,021 | 12/1966 | Blachly et al. | 261/91 |
| 3,421,745 | 1/1969 | Prupis | 261/DIG. 15 |
| 3,572,658 | 3/1971 | Ravitts | 261/120 |
| 3,864,437 | 2/1975 | Blaszkowski | 261/120 |
| 3,936,283 | 2/1976 | Solis | 261/91 |
| 4,235,373 | 11/1980 | Clark | 239/34 |
| 4,624,806 | 11/1986 | Koszyk | 261/91 |

FOREIGN PATENT DOCUMENTS

| | | | |
|---|---|---|---|
| 615010 | 12/1979 | Switzerland | 261/120 |
| 107693 | 7/1917 | United Kingdom | 261/91 |
| 862762 | 3/1961 | United Kingdom | 261/91 |

*Primary Examiner*—Tim Miles

*Attorney, Agent, or Firm*—Hill, Van Santen, Steadman & Simpson

[57] ABSTRACT

A portable humidifier for insertion into a receptacle for water, including an outer housing which has outlet openings formed therein, a support structure for holding the housing in depending relation within the liquid receptacle, and a driven fan positioned in the housing and arranged to draw moisture-laden air up through the housing and out the outlet passages. An inner housing is slidably received within the outer housing in telescoping relation. A secondary, non-driven fan is positioned within the inner housing for rotation therein and is arranged to disperse water droplets into the airflow created by operation of the driven fan. An air inlet means is arranged to direct air through the inner housing to be propelled with the water droplets upwardly into the outer housing for discharge through the outlet openings. The device is foldable to a compact structure making it convenient to be carried in a suitcase or the like.

7 Claims, 4 Drawing Figures

PORTABLE HUMIDIFIER

BACKGROUND OF THE INVENTION

1. Field of the Invention

The present invention is in the field of portable humidifiers for dispersing atomized moisture into the surrounding air to thereby increase its relative humidity. The device makes use of an inner and outer housing which are automatically adjusted relative to each other by the level of water in which the bottom of the humidifier is immersed.

2. Description of the Prior Art

The ill effects of excessively dry air are known, and include sinus problems, sore throats and the like. Frequent travelers may find themselves in a situation where their lodging spaces circulate air which is uncomfortably dry. Rudimentary measures such as leaving open pans of water around the living space or operating a shower for a long period of time are not really practical.

There are examples in the prior art of devices intended to atomize moisture into an airstream but for the most part these devices are relatively bulky and do not lend themselves to portability.

Collins U.S. Pat. No. 1,178,575 describes a ventilating type fan which includes a vertical rotary shaft in combination with an annular deflector concentric with the shaft. An impeller blade forces air against the deflector, and the resulting airstream picks up water from an annular water receptacle adjacent to the outer edge of the deflector.

Lyon U.S. Pat. No. 2,755,129 describes a humidifier having a self-contained electric motor with a drive shaft extending downwardly into a receptacle. The lower end of the shaft is seated in a bearing on the bottom wall of the receptacle, the portion of the shaft thus seated having a plurality of spiral grooves which function as a pump for elevating water to an atomizing blade secured to the shaft. A diffusing blade is also provided above the atomizing blade.

In U.S. Pat. No. 4,235,373 to Clark there is disclosed a fluid dispenser consisting of a container, a release means communicating with an outlet, and actuating means coupled to the release means for periodically operating the release means. The container has a convection chamber into which air is introduced at the bottom and discharged at the top. In the convection chamber there is a downwardly extending absorbent surface arranged to receive the fluid to permit dispersion downwardly on the surface and vaporization of the fluid into the convection airflow. The downwardly extending surface is provided with a series of generally transversely extending individual channels each having at least one centrally depressed chevron shape and so arranged so that it channels the fluid between the staggered arrangement of channels.

SUMMARY OF THE INVENTION

The present invention provides a portable humidifier including an outer casing having outlet openings formed therein, and support means which extend radially outwardly from the housing and are arranged to dependently support the housing within a liquid receptacle. A driven fan is positioned in the housing and is arranged to draw moisture-laden air up through the housing and out the outlet openings. An inner housing is slidably received within the outer housing in telescoping relation. A secondary, non-driven fan is positioned within the inner housing for rotation therein and is arranged to disperse water droplets into the air flow created by rotation of the fan. An air inlet means is arranged to direct air through the inner housing to be propelled with the water droplets upwardly into the outer housing for discharge through the outlet openings. Automatic adjustment of the positioning of the device with relation to an available water supply is accomplished by means of a flotation collar which supports the inner housing in which the non-driven fan is located. The fan blades are coupled to a shaft which terminates in a needle end received in bearing relation within a needle point bearing.

In a preferred embodiment of the invention, the support means are made foldable so that the entire device can be folded into a convenient size for transport, for example, in a suitcase. The support means are also proportioned so that they can support the humidifier in depending relation within an ice bucket of the type normally found in hotel and motel accommodations.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
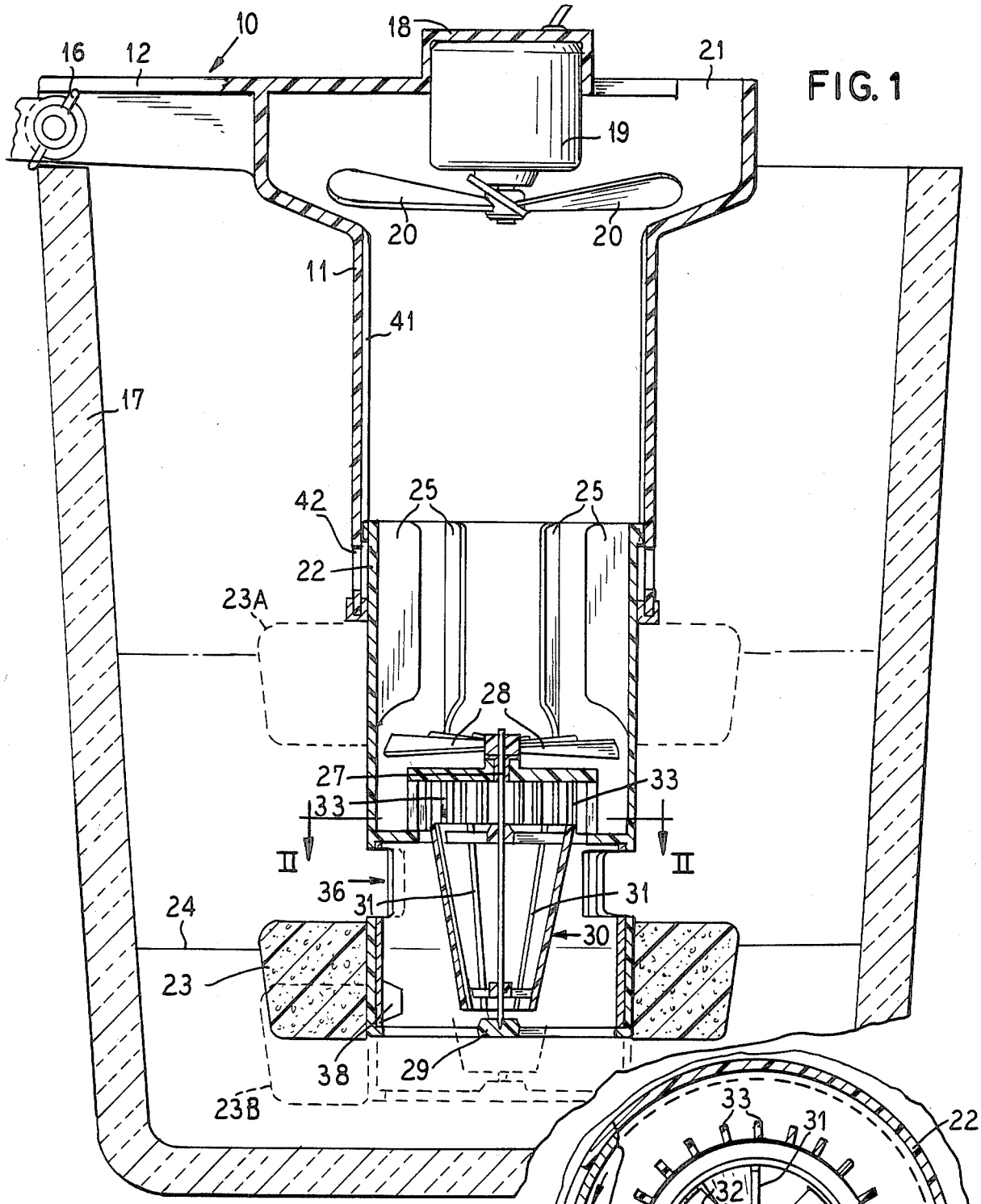
FIG. 1 is a view partly in elevation and partly in cross section illustrating the interior of the portable humidifier device of the present invention while positioned in an ice bucket.

In FIG. 1, reference numeral 10 indicates generally a portable humidifier constructed according to the present invention. The humidifier 10 includes an outer wall 11 having integral therewith three support arms 12, 13 and 14 best seen in FIG. 3. As shown in that Figure, each of the radially extending, angularly spaced arms 12, 13 and 14 is provided with a hinge means enabling the entire humidifier structure to be folded into a more compact arrangement. Such hinge means may include bolts 15 and wing nuts 16.

When in extended relation, the support arms 12, 13 and 14 serve to bridge across a liquid receptacle in which the humidifier is immersed. Such receptacle may, for example, consist of a plastic ice bucket 17 of the type which is commonly provided for use by the occupant of a hotel or motel room.

Figure 3:
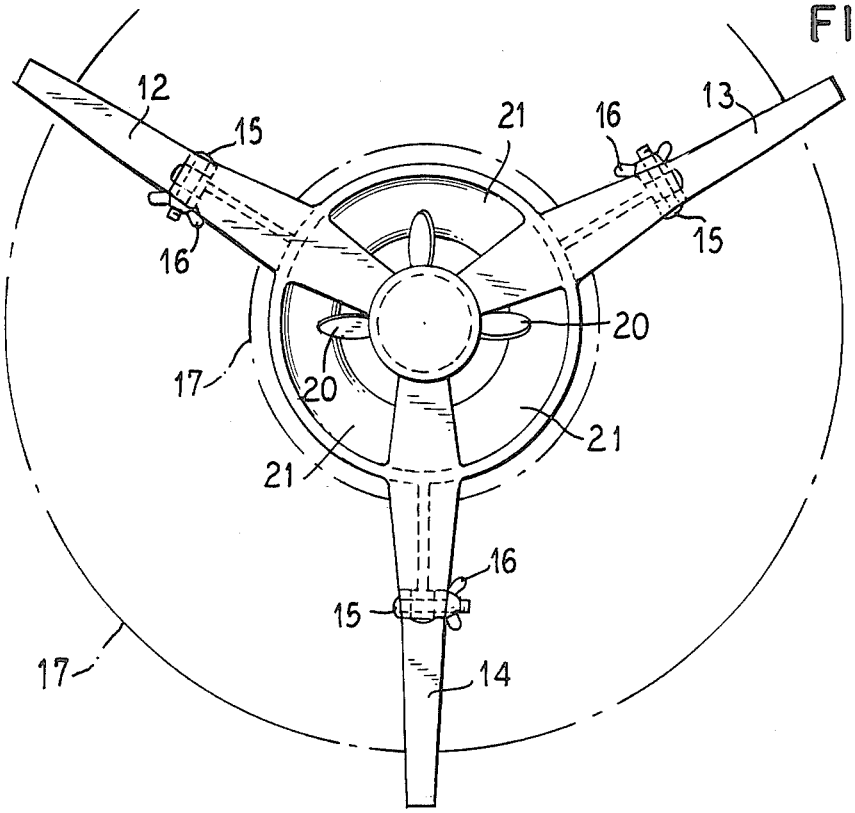
FIG. 3 is a plan view of the portable humidifier device shown in FIGS. 1 and 2.
Figure 4:
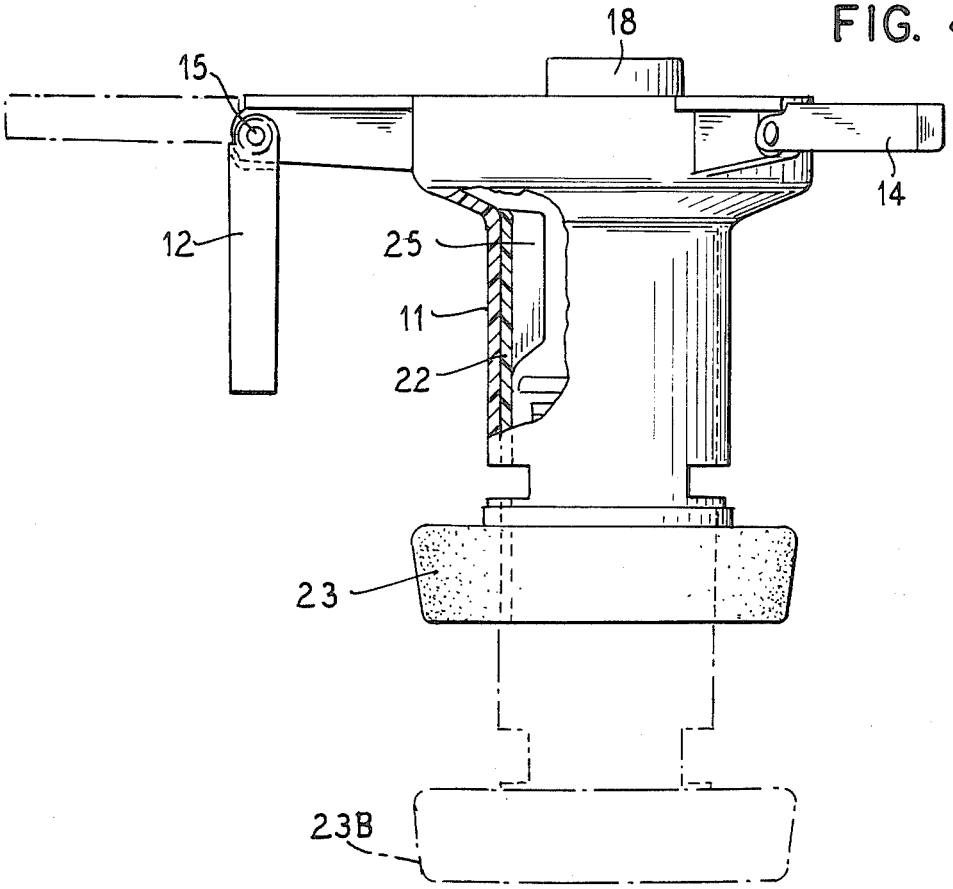
FIG. 4 is a fragmentary view in elevation of the device showing the manner in which the support arms can be folded and also illustrating the interrelationship between the interfitting portions of the device when the flotation collar is at its maximum upward position.

The upper portion of the outer housing 11 contains a recessed compartment 18 in which there is located a motor 19 which drives spaced fan blades 20. As shown in FIG. 3, the upper portion of the outer housing 11 also is provided with discharge or outlet openings 21 through which the airstream containing atomized water particles is injected into the surrounding atmosphere.

Slidably received in telescoping relation within the interior of the outer housing 11 is an inner housing 22. Internal ribs 41 are provided along the outer housing 11 to fit within grooves in the inner housing 22 to accommodate non-rotating sliding relative movement. The relative displacement between the inner housing 22 and the outer housing 11 is governed by the amount of water contained in the bucket 17. To this end, the inner housing 22 is coupled to a flotation collar 23 composed of a suitably buoyant material such as a cellular synthetic resin. FIG. 1 illustrates the position of the flotation collar 23 with respect to an existing waterline 24. The maximum upward position of the flotation collar 23 is indicated by dashed lines at 23A while the lowermost position of the collar is indicated by the dashed line showing 23B.

The inner housing 22 also carries a plurality of radially inwardly extending baffles 25 best seen in FIG. 1. These baffles tend to stabilize the flow of the moisture-laden air upwardly as it is drawn by the movement of the fan blades 20, and serve to prevent water drops from accumulating on the walls of the housing.

Immediately below the baffles 25 is a second fan structure consisting of a non-driven fan or slave fan assembly. This secondary, non-driven fan includes a shaft 27 on which there is mounted a collar containing impeller vanes or blades 28. The shaft 27 is formed at its lower end with a needle point which is received in bearing relationship in a needle point bearing 29.

The shaft 27 extends through an open cone 30 having angularly disposed ribs 31 extending from the large diameter to the small diameter of the cone. Internal spokes 32 are provided to rigidify the cone structure.

Figure 2:
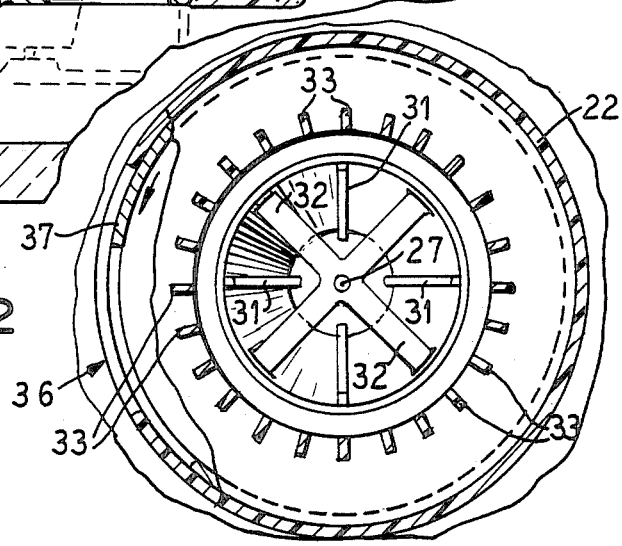
FIG. 2 is a fragmentary cross-sectional view taken substantially along the line II—II of FIG. 1.

Disposed immediately above the cone 30 is another set of baffles 33 which serve to help atomize the water which fills the lower portion of the compartment in which the cone 30 is located, rising up to the level of the waterline 24. Air is introduced above the waterline through an air inlet generally indicated at reference numeral 36 and provided by an internal sleeve 37 (FIG. 2) which is rotatable relative to the housing and is adjustable to control the amount of air being introduced. For that purpose, there is provided an adjustment tab 38 which can be moved to enlarge or decrease the width of the air inlet 36 as desired. In order to provide for airflow when the inner housing 22 is in its completely collapsed condition, an air inlet 42 is provided in the outer housing 11 to communicate with the air inlet 36 in that condition.

In operation, as the motor 19 drives the fan blades 20, air is drawn up through the air inlet 36, causing the secondary or slave fan blades 28 to rotate. Moisture drawn up from the body of water in which the humidifier is partly immersed is atomized by the action of the ribs 31 and the baffles 33 from which it is discharged radially outwardly and finds its way between the baffles 25. The movement of the atomized moisture particles and the updraft created by the fan 20, aided by the fan blades 28, serves to keep the atomized moisture particles in suspension without coalescence and without depositing on the walls of the housing as they otherwise might because of the effects of centrifugal force.

The portable humidifier of the present invention thus provides a convenient, portable mechanism for introducing significant quantities of moisture-laden air into a dry atmosphere. The device is self-adjusting over a wide range of water levels and provides an efficient distribution of moisture-laden cool air into a dry environment.

It should be evident that various modifications can be made to the described embodiments without departing from the scope of the present invention.

I claim as my invention:

1. A portable humidifier comprising:

an outer housing having outlet openings formed therein, support means extending radially outwardly from said housing and arranged to dependently support said housing within a liquid receptacle, a driven fan positioned in said housing and arranged to draw moisture-laden air up through said housing and out said outlet openings, an inner housing slidably received within said outer housing in telescoping relation without relative rotative movement therebetween, a flotation collar on said inner housing supporting said inner housing for flotation on a body of liquid contained in said liquid receptacle, a secondary, non-driven fan positioned within said inner housing for rotation therein and arranged to disperse water droplets into the airflow passing thereby, and air inlet means arranged to direct air radially inwardly through said inner housing to be propelled with said water droplets upwardly into said outer housing for discharge through said outlet openings.

2. A portable humidifier according to claim 1 which includes adjustment means cooperating with said air inlet means to control the amount of air entering therethrough.

3. A portable humidifier according to claim 1 including:

a motor carried by said outer housing and drivingly connected to said driven fan.

4. A portable humidifier according to claim 1 wherein said secondary non-driven fan includes fan blades, a shaft supporting said fan blades for rotation, and bearing means receiving the lower end of said shaft in bearing relation.

5. A portable humidifier according to claim 4 which includes:

an internally ribbed open cone secured to said shaft to assist in atomizing water droplets into the airstream being drawn up by said driven fan.

6. A portable humidifier according to claim 4 wherein said bearing means is a needle point bearing.

7. A portable humidifier according to claim 4 wherein said shaft is coaxial with the vertical axis of said outer housing.

* * * * *